US005546619A

United States Patent [19]

Braun

[11] Patent Number: 5,546,619

[45] Date of Patent: Aug. 20, 1996

[54] HEAD SUPPORTING DEVICE FOR USE WHILE SUNTANNING

[76] Inventor: Mary J. Braun, 481 Anaconda Dr., Colorado Springs, Colo. 80919

[21] Appl. No.: 369,079

[22] Filed: Jan. 5, 1995

[51] Int. Cl.[6] ..... A47C 20/02

[52] U.S. Cl. ..... 5/638; 5/640; 5/643

[58] Field of Search ..... 5/636–645, 310, 5/312

[56] References Cited

U.S. PATENT DOCUMENTS

| | | | |
|---|---|---|---|
| 2,239,003 | 4/1941 | Jones | 5/638 |
| 2,452,816 | 11/1948 | Wagner | 5/636 |
| 2,461,434 | 2/1949 | Moyers | 5/638 |
| 4,620,697 | 11/1986 | Pithon | 5/640 |
| 5,177,823 | 1/1993 | Riach | 5/636 |
| 5,214,815 | 6/1993 | Agbodoe | 5/637 |

*Primary Examiner*—Flemming Saether

[57] ABSTRACT

A new and improved head support which enables a user to comfortably rest upon his or her stomach. The support includes a horseshoe-shaped head support having a first opened end, a second closed end, an inner periphery, an outer periphery, an upper surface, a lower surface, a first side and a second side. The inner periphery is adapted to support a user's head. A first set of legs is provided for supporting the first side of the rigid head support. Each leg of the first set is pivotally connected to the lower surface of the head support. Furthermore, each leg of the first set has a first position adjacent the lower surface of the head support, and a second position substantially perpendicular to the lower surface of the head support. A second set of legs is provided for supporting the second side of the rigid head support. Each leg of the second set is pivotally connected to the lower surface of the head support, with each leg of the second set having a first position adjacent the lower surface of the head support, and a second position substantially perpendicular to the lower surface of the head support.

1 Claim, 4 Drawing Sheets

HEAD SUPPORTING DEVICE FOR USE WHILE SUNTANNING

BACKGROUND OF THE INVENTION

1. Field of the Invention

The present invention relates to a padded head rest and more particularly pertains to a head rest with foldable legs.

2. Description of the Prior Art

The use of face pillows is known in the prior art. More specifically, face pillows heretofore devised and utilized for the purpose of supporting the head are known to consist basically of familiar, expected, and obvious structural configurations, notwithstanding the myriad of designs encompassed by the crowded prior art which has been developed for the fulfillment of countless objectives and requirements.

For example, U.S. Design Patent U.S. Pat. No. 298,992 to Voss and U.S. Pat. No. 5,044,026 to Matthews each disclose a face pillow.

Furthermore, U.S. Design Patent U.S. Pat. No. 309,542 to Glenn and U.S. Pat. No. 5,095,569 to Glenn each disclose face down pillows.

Lastly, U.S. Pat. No. 5,216,772 to Clute discloses a support pillow.

In this respect, the padded head rest according to the present invention substantially departs from the conventional concepts and designs of the prior art, and in doing so provides an apparatus primarily developed for the purpose of supporting a user's head.

Therefore, it can be appreciated that there exists a continuing need for a new and improved padded head rest which can be used for supporting a user's head. In this regard, the present invention substantially fulfills this need.

SUMMARY OF THE INVENTION

In view of the foregoing disadvantages inherent in the known types of face pillows now present in the prior art, the present invention provides an improved padded head rest. As such, the general purpose of the present invention, which will be described subsequently in greater detail, is to provide a new and improved padded head rest and method which has all the advantages of the prior art and none of the disadvantages.

To attain this, the present invention essentially comprises a head support which enables a person to comfortably rest upon his or her stomach. The support includes a rigid horseshoe- shaped head support having a first opened end, a second closed end, an inner periphery, an outer periphery, an upper surface, a lower surface, a first side and a second side. Two sockets are formed within the first side lower surface and two sockets are formed within the second side lower surface. The inner periphery is adapted to support a user's head. A layer of resilient cushioning covers all the surfaces of the rigid head support, the cushioning permitting access to the two sockets formed within the first side lower surface and within the sockets formed within the second side lower surface. A first set of legs serves to support the first side of the rigid head support, each leg of the first set having a first ball-shaped end and a second surface engaging end, each ball-shaped end secured within one of the sockets formed within the first side lower surface of the head support, each leg of the first set having a first position adjacent the lower surface of the head support, and a second position substantially perpendicular to the lower surface of the head support. Means are included to positively lock each of the legs of the first set in the second position substantially perpendicular to the lower surface of the head support. A second set of legs supports the second side of the rigid head support, with each leg of the second set having a first ball-shaped end and a second surface engaging end, each ball-shaped end secured within one of the sockets formed within the second side lower surface of the head support, each leg of the second set having a first position adjacent the lower surface of the head support, and a second position substantially perpendicular to the lower surface of the head support. Means are included to positively lock each of legs of the second set in the second position substantially perpendicular to the lower surface of the head support.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent of legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved padded head rest which has all the advantages of the prior art face pillows and none of the disadvantages.

It is another object of the present invention to provide a new and improved padded head rest which may be easily and efficiently manufactured and marketed.

It is a further object of the present invention to provide a new and improved padded head rest which is of durable and reliable constructions.

An even further object of the present invention is to provide a new and improved padded head rest which is susceptible of a low cost of manufacture with regard to both materials and labor, and which accordingly is then susceptible of low prices of sale to the consuming public, thereby making such padded head rest economically available to the buying public.

Still yet another object of the present invention is to provide a new and improved padded head rest which provides in the apparatuses and methods of the prior art some of the advantages thereof, while simultaneously overcoming some of the disadvantages normally associated therewith.

Even still another object of the present invention is to provide a padded head rest with foldable legs.

Lastly, it is an object of the present invention to provide a new and improved head support which enables a user to comfortably rest upon his or her stomach. The support includes a horseshoe-shaped head support having a first opened end, a second closed end, an inner periphery, an outer periphery, an upper surface, a lower surface, a first side and a second side. The inner periphery is adapted to support a user's head. A first set of legs is provided for supporting the first side of the rigid head support. Each leg of the first set is pivotally connected to the lower surface of the head support. Furthermore, each leg of the first set has a first position adjacent the lower surface of the head support, and a second position substantially perpendicular to the lower surface of the head support. A second set of legs is provided for supporting the second side of the rigid head support. Each leg of the second set is pivotally connected to the lower surface of the head support, with each leg of the second set having a first position adjacent the lower surface of the head support, and a second position substantially perpendicular to the lower surface of the head support.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various Figures.

DESCRIPTION OF THE PREFERRED EMBODIMENT

Figure 1:
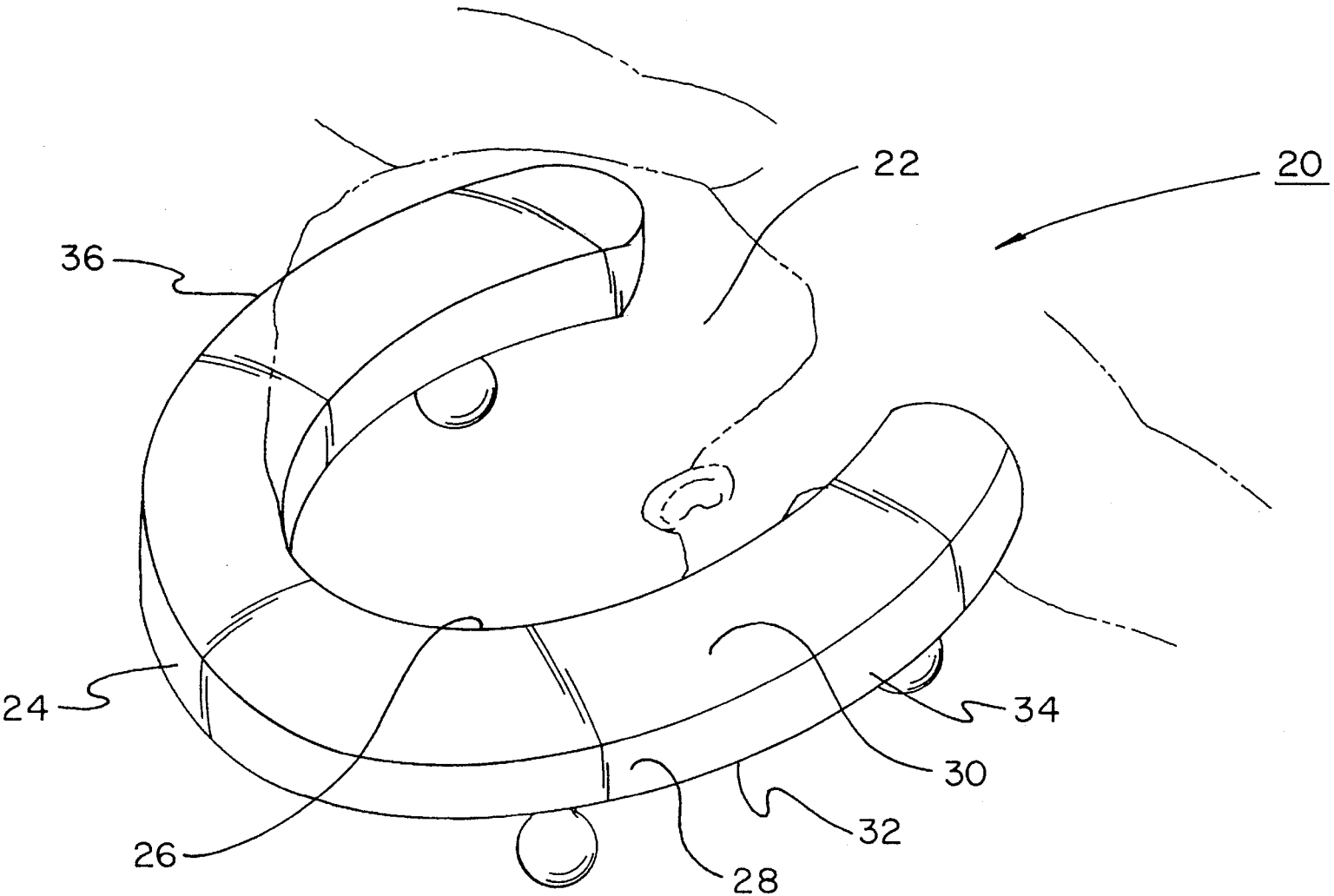
FIG. 1 is a perspective view of the preferred embodiment of the padded head rest constructed in accordance with the principles of the present invention.
Figure 2:
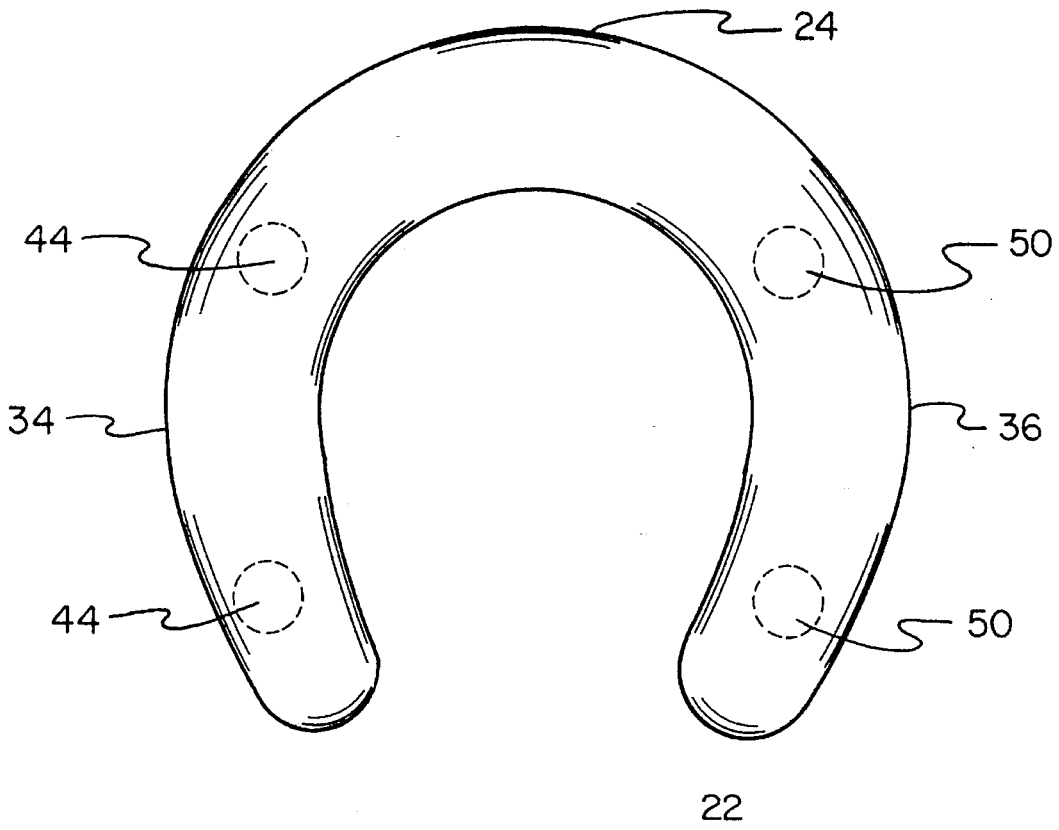
FIG. 2 is a plan view of the padded head rest.
Figure 3:
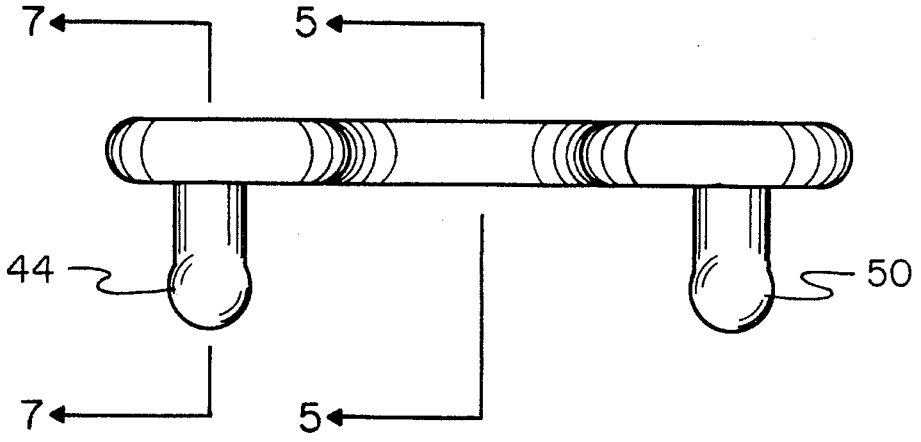
FIG. 3 is a side elevational view of the padded head rest.
Figure 4:
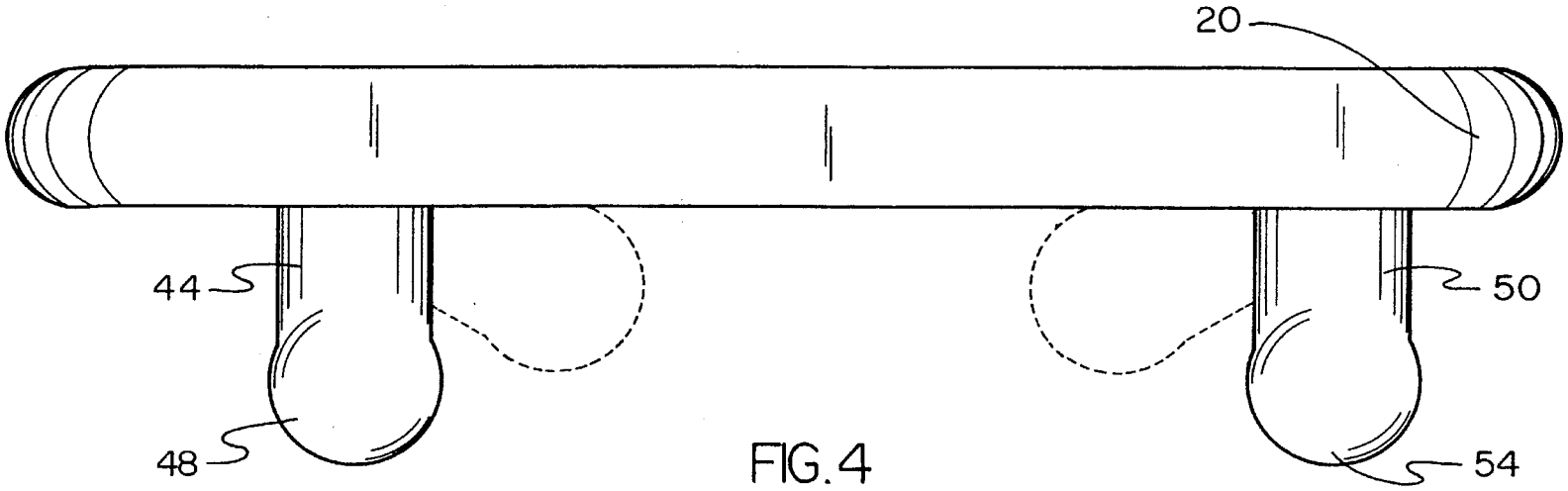
FIG. 4 is a side elevational view of the head rest with the two legs positions illustrated.
Figure 5:
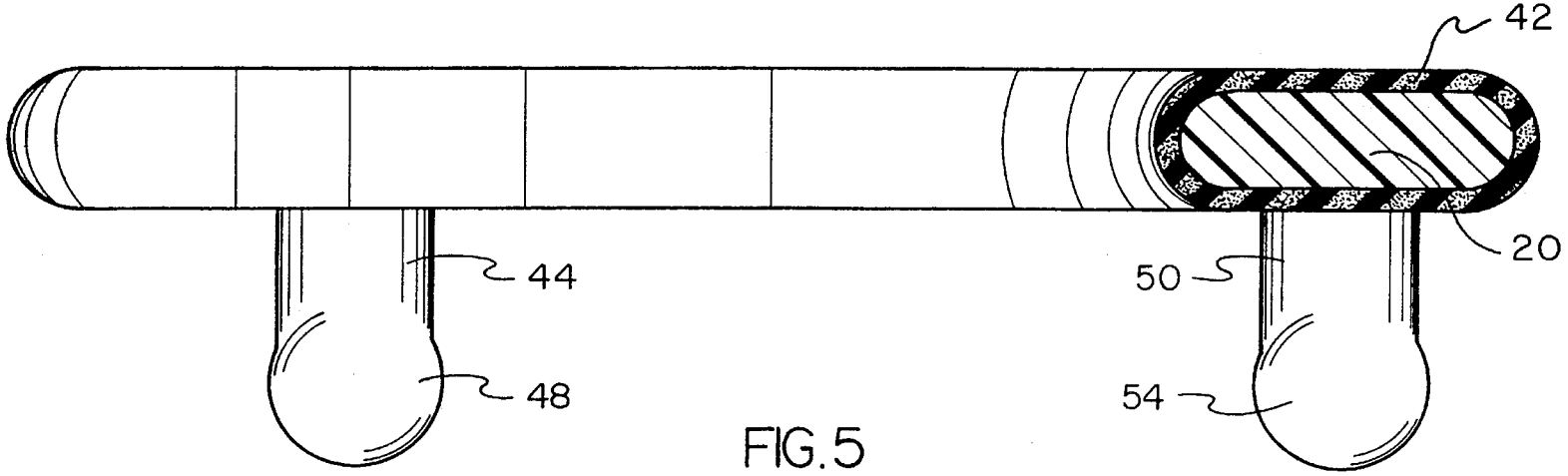
FIG. 5 is a sectional view of the padded head rest.
Figure 6:
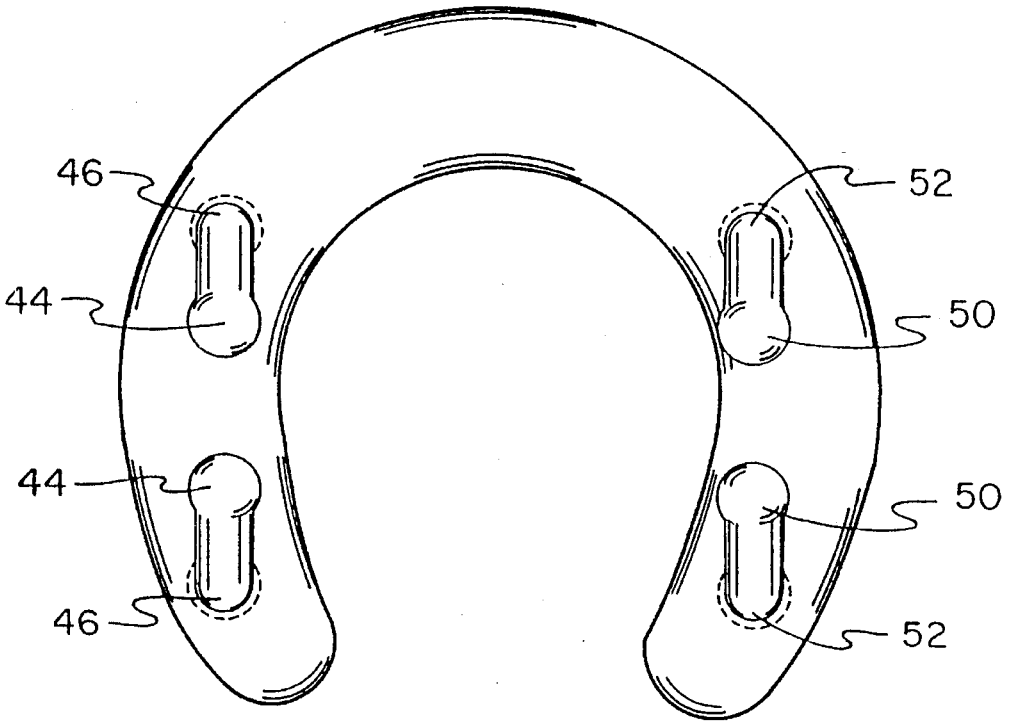
FIG. 6 is a view taken along line 5—5 of FIG. 3.
Figure 7:
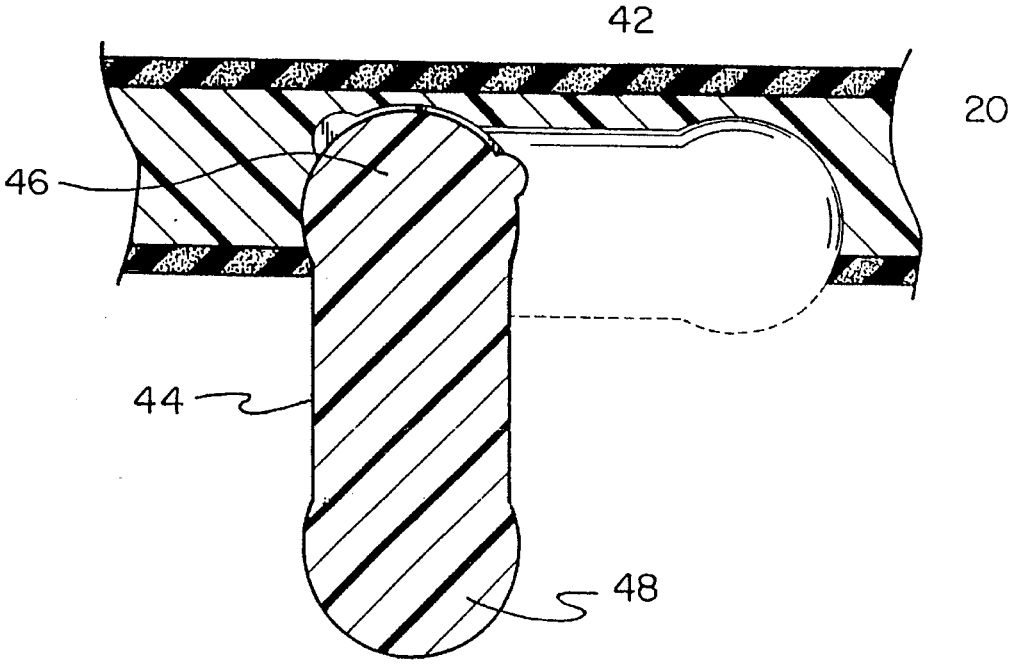
FIG. 7 is a view taken along line 7—7 of FIG. 3.

With reference now to the drawings, and in particular to FIG. 1 thereof, the preferred embodiment of the new and improved padded head rest embodying the principles and concepts of the present invention and generally designated by the reference numeral 10 will be described.

The present invention relates to a head support 20 device which allows a user to comfortably rest upon their stomach. In its broadest context, the present invention includes a horseshoe-shaped head support 20 supported by two sets of legs. Each of the legs is pivotally connected to the head support 20 by way of a ball and socket joint. Furthermore, each of the legs has a first position adjacent the lower surface 32 of the head support 20 and a second position substantially perpendicular to the head support 20. The details of the various components and the manner in which they interrelate will be described in greater detail hereinafter.

The rigid horseshoe-shaped head support 20 is formed from a first opened end 22, a second closed end 24, an inner periphery 26, an outer periphery 28, an upper surface 30, a lower surface 32, a first side 34 and a second side 36. Furthermore, two sockets 38 are formed within the first side 34 lower surface 32 and two sockets 40 formed within the second side 36 lower surface 32. The inner periphery 26 of the head support 20 is specifically adapted to support a user's head. In order to facilitate a user's comfort a layer of resilient cushioning 42 can be provided over all the surfaces of the rigid head support 20. The cushioning 42 would, however, permit access to the two sockets 38 formed within the first side 34 lower surface 32 and within the sockets 40 formed within the second side 36 lower surface 32. The materials employed in forming the cushioning 42 can be of a conventional nature, for example, foam padding, resilient plastic, or cotton.

A first set of legs 44 is employed for supporting the first side 34 of the rigid head support 20. Each leg of the first set is formed from a first ball-shaped end 46 and a second surface engaging end 48. Furthermore, each ball-shaped end is secured within one of the sockets formed within the first side 34 lower surface 32 of the head support 20. Each leg of the first set can be selectively placed in one of two positions; a first position adjacent the lower surface 32 of the head support 20, and a second position substantially perpendicular to the lower surface 32 of the head support 20. The device also includes means to positively lock each of legs 44 of the first set in their second position. This means can take any one of a variety of forms known in the art. In the preferred embodiment, a detent is formed upon all of the ball-shaped ends of the legs and a corresponding notch is formed within all of the sockets. This detent and notch arrangement positively locks any one of the legs in its second position.

The second set of legs 50 is employed for supporting the second side 36 of the rigid head support 20. The details for the second set of legs 50 are the same as for the first set. However, the details of the second set of legs 50 will be reiterated. Each leg of the second set is formed from a first ball-shaped end 52 and a second surface engaging end 54. Furthermore, each ball-shaped end is secured within one of the sockets formed within the second side 36 lower surface 32 of the head support 20. Each leg of the second set can be selectively placed in one of two positions; a first position adjacent the lower surface 32 of the head support 20, and a second position substantially perpendicular to the lower surface 32 of the head support 20. The device also includes means to positively lock each of legs of the second set in their second position. This means can take any one of a variety of forms known in the art. In the preferred embodiment, a detent is formed upon all of the ball-shaped ends of the legs and a corresponding notch is formed within all of the sockets. This detent and notch arrangement positively locks any one of the legs in its second position.

In use, a user first positively locks each of the legs of the device to its second position. The head support 20 is then placed upon the ground with the ground engaging ends of all the legs supporting the device. The device in now ready for use. A user can now place the face within the center of the device, ie. the user's face adjacent the ground. In this orientation, a user can comfortably rest upon his or her stomach. In the alternative, a user can rest his or her head upon the device in the opposite orientation, ie. the back of the user's head placed within the center of the device.

Thus, the present invention is a formed cushion pad in which the user's head is placed, relieving neck and shoulder pain due to stress or tired muscles. The device measures approximately 15 inches in length and 12 inches in width. It is a "U"-shaped pillow which contains three inches of padding. The bottom of this pillow features a solid formed material and four collapsible legs which measure four to six inches in height. They are attached to the solid piece by ball and socket joints, enabling them to be snapped and secured in a standing position, or folded flat against the piece. Each leg features a rounded footing which enables it to remain steady during use. This cushion could be produced from a soft washable vinyl material and manufactured in a variety of colors and designs. Each of the four legs is lifted upward and snapped into a locked position within the socket. The pillow is then turned into an upright position and the user's face placed gently onto the soft padding so that the chin is resting in the open end of the pillow. Depending upon the muscle aches and needs of the individual, he/she may lie facing downward or upward. By keeping the head and neck in proper alignment with the spine, this pillow eliminates muscle aches and pains caused by stress. This extremely portable and therapeutic device enables the user to effectively reduce and prevent muscle strain within the neck and shoulder area without the need of medication or other expensive forms of therapy.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A head support which enables a person to comfortably rest upon his or her stomach, the head support comprising, in combination:

a rigid horseshoe-shaped head support having a first opened end, a second closed end, an inner periphery, an outer periphery, an upper surface, a lower surface, a first side and a second side, two sockets formed within the first side lower surface and two sockets formed within the second side lower surface, the inner periphery adapted to support a user's head;

a layer of resilient cushioning covering all the surfaces of the rigid head support, the cushioning permitting access to the two sockets formed within the first side lower surface and within the sockets formed within the second side lower surface;

a first set of legs for supporting the first side of the rigid head support, each leg of the first set having a first ball-shaped end and a second surface engaging end, each ball-shaped end secured within one of the sockets formed within the first side lower surface of the head support, each leg of the first set having a first position adjacent the lower surface of the head support, and a second position substantially perpendicular to the lower surface of the head support;

means to positively lock each of the legs of the first set in the second position substantially perpendicular to the lower surface of the head support;

a second set of legs for supporting the second side of the rigid head support, each leg of the second set having a first ball-shaped end and a second surface engaging end, each ball-shaped end secured within one of the sockets formed within the second side lower surface of the head support, each leg of the second set having a first position adjacent the lower surface of the head support, and a second position substantially perpendicular to the lower surface of the head support; and means to positively lock each of the legs of the second set in the second position substantially perpendicular to the lower surface of the head support.

* * * * *